US005248354A

United States Patent [19]

Tada et al.

[11] Patent Number: 5,248,354

[45] Date of Patent: Sep. 28, 1993

[54] METHOD FOR THE PREPARATION OF A BODY OF AUSTEMPERED DUCTILE CAST IRON

[75] Inventors: Shuji Tada; Toshio Takahashi, both of Sendai; Toshihiko Abe, Tagajo, all of Japan

[73] Assignee: Agency of Industrial Science and Technology, Tokyo, Japan

[21] Appl. No.: 946,857

[22] Filed: Sep. 18, 1992

[30] Foreign Application Priority Data

Sep. 18, 1991 [JP] Japan ..... 3-268203

[51] Int. Cl.[5] ..... C21D 5/00

[52] U.S. Cl. ..... 148/614; 148/545; 148/627; 148/631; 148/639

[58] Field of Search ..... 148/614, 545, 321, 627, 148/631, 639

[56] References Cited

FOREIGN PATENT DOCUMENTS 2109814A 6/1983 United Kingdom ..... 148/545

2112811A 7/1983 United Kingdom ..... 148/545

*Primary Examiner*—R. Dean

*Assistant Examiner*—Sikyin Ip

*Attorney, Agent, or Firm*—Wenderoth, Lind & Ponack

[57] ABSTRACT

A unique method is proposed for the preparation of a body of an austempered ductile cast iron having a gradient of the mechanical property within the body by subjecting a body of a nodular graphite cast iron to an isothermal transformation treatment for austempering at a temperature in the range from 250° to 450° C. while the body has a temperature difference between two points or between two surfaces. The temperature difference can be produced by bringing the two points or two surfaces into contact with melts of a salt kept at different temperatures. A two-compartment salt-bath apparatus therefore is disclosed.

1 Claim, 3 Drawing Sheets

METHOD FOR THE PREPARATION OF A BODY OF AUSTEMPERED DUCTILE CAST IRON

BACKGROUND OF THE INVENTION

The present invention relates to a method for the preparation of a body of an austempered ductile cast iron or, more particularly, to a unique method for the preparation of a body of an austempered ductile cast iron having a gradient o the mechanical properties within the body along with excellent toughness and strength suitable as a substitute material for a forged steel.

It is an established process highlighted in recent years to prepare an austempered ductile cast iron, referred to as an ADI hereinafter, having good mechanical properties suitable as a substitute material for conventional forged steels by subjecting a body of a nodular graphite cast iron to an austempering heat treatment.

The austempering heat treatment of a nodular graphite cast iron to obtain an ADI is carried out usually at a temperature in the range from 250° to 450° C. while the mechanical properties of the thus obtained ADI largely depend on the treatment temperature so that various grades of ADI materials having mechanical properties to meet the requirements in a particular application can be obtained by controlling the temperature in the austempering treatment. For example, ADI materials are classified in Japanese Industrial Standards (JIS) into three grades including a high-toughness grade of FCD900A, a high-hardness grade of FCD1200A and a grade of FCD1000A having intermediate characteristics between the former two.

Since it is a usual practice that the temperature distribution in the atmosphere or bath for a heat treatment is controlled to be as uniform as possible, any body of an ADI material naturally has a substantially uniform distribution of the mechanical properties such as toughness and strength throughout the body determined by the selected temperature for the austempering heat treatment. Needless to say, it is not always the optimum that a structural member has uniform mechanical properties throughout the body or in all of the directions or points within the body. Rather, it would be sometimes desirable that a structural member has a gradient in the mechanical properties each point having properties differing from the other points so that the requirements for the structural member, which may vary from point to point, can be satisfied most satisfactorily. For example, a cylinder piston of an internal combustion engine is required to have a high hardness on the surface in a sliding contact with the cylinder walls while the upper part of the piston member to be connected with the piston rod should desirably have a high tensile strength and toughness. Nevertheless, no prior art method is known for the preparation of a body of an ADI having a graident of the mechanical properties within the body.

SUMMARY OF THE INVENTION

The present invention accordingly has an object to provide a unique method for the preparation of a body of an austempered ductile cast iron having a gradient of the mechanical properties within the body.

Thus, the method of the present invention for the preparation of a body of an austempered ductile cast iron comprises: subjecting a body of a nodular graphite cast iron to an isothermal transformation treatment for austempering while the temperature of the body under the treatment has a substantial gradient within the body or the body has a temperature distribution differing between two points.

DETAILED DESCRIPTION OF THE PREFERRED EMBODIMENTS

As is described above, the most characteristic feature of the inventive method consists in the unique temperature conditions in the austempering heat treatment of a body made from a nodular graphite cast iron to prepare an ADI body. Namely, the isothermal transformation treatment of the starting body for austempering is carried out while a substantial gradient is maintained of the temperature within the body under treatment or a substantial temperature difference is maintained during the austempering heat treatment between two points or surfaces within the body under treatment.

The form of the starting body made from a nodular graphite cast iron is not particularly limitative and the method of the present invention is applicable to any starting body irrespective of the form thereof. Typically, for example, when the starting body is a plate or slab of a nodular graphite cast iron, the austempering heat treatment of the plate or slab is carried out while the two surfaces thereof are kept at a temperature differing each from the other. Such a temperature difference can be produced and maintained by having the two surfaces of the plate or slab in contact with molten salt baths controlled at different temperatures. It is of course a possible way, if so desired, to have a temperature difference or gradient within the plane of the plate or slab. When the starting body is a pipe, the temperature gradient can be produced between the inner surface and outer surface of the pipe by bringing the surfaces into contact with melts of a salt controlled at different temperatures.

The temperature difference to be produced between two points or su faces within the body under treatment naturally depends on the desired degree of the gradient of the mechanical properties in the ADI body prepared by the treatment although both of the higher and the lower temperatures must be within the temperature range, i.e. 250° to 450° C., suitable for the austempering treatment. In other words, the temperature difference can be small enough provided that a significant difference from a point to the other point or from a surface to the other surface can be produced in the mechanical properties of the ADI body obtained by the treatment. For example, a temperature difference of 10° C. or larger or, in most cases, 50° C. or larger usually can produce a significant difference in one or more of the mechanical properties between the points treated at the higher and lower temperatures.

Figure 1A:
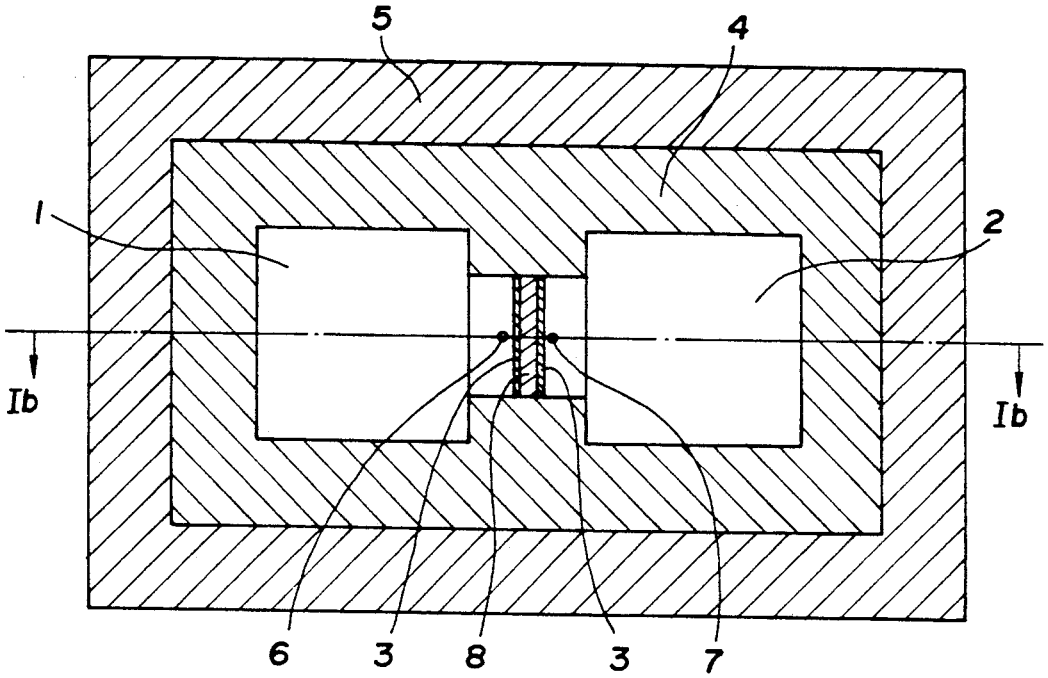
FIGS. 1*a* and 1*b* are each a plan view and a vertical cross sectional view, respectively, of a salt bath apparatus for practicing the method of the invention.
Figure 1B:
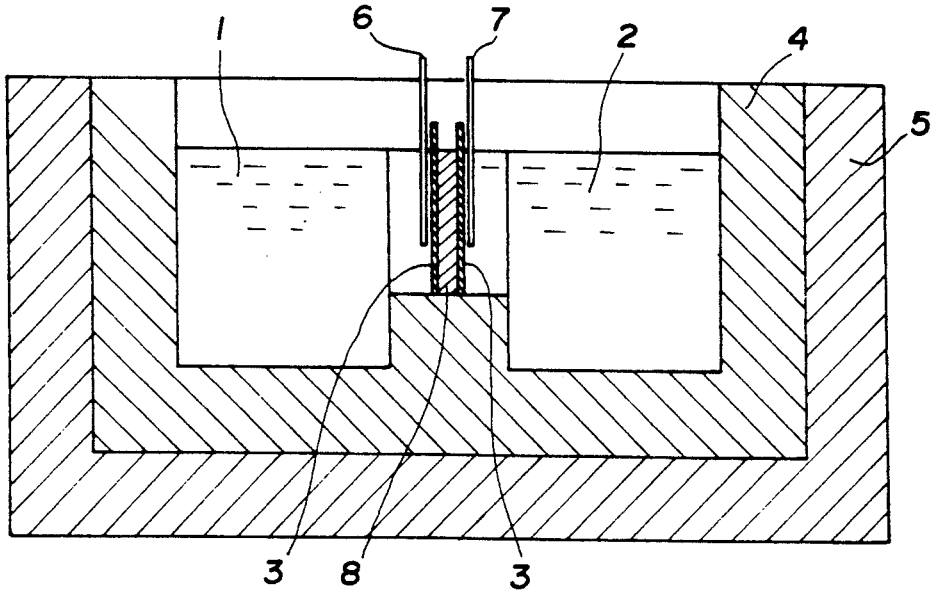

Following is a description of a typical embodiment of the inventive method, in which the starting body of a nodular graphite cast iron is in the form of a slab, making reference to FIGS. 1*a* and 1*b* of the accompanying drawing illustrating a plan view and a vertical cross sectional view, respectively, of a salt-bath apparatus for practicing the inventive method.

The apparatus has two salt-bath compartments 1 and 2 communicatable each with the other but partitioned by a pair of partitioning boards 3,3 which prevent mixing of the melts of a salt contained in the compartments 1,2 kept at a higher and a lower temperatures, respectively. The two salt-bath compartments 1,2 are jointly constructed with a refractory material forming the walls 4 and surrounded with a suitable heat-insulating material 5 such as rock wool. The partitioning board 3 is made, for example, from stainless steel. It is important that the molten salt bath in each of the compartments 1 and 2 has a volume and hence a heat capacity large enough in order to minimize the influence on the temperature of the respective salt baths caused by the flow of heat through the partitioning boards 3,3. Each of the salt-bath compartments 1,2 is provided with a stirrer (not shown in the figures) in order to ensure uniformity of the temperature of the salt bath contained in the respective compartments 1,2. The temperatures of the salt baths in the compartments 1,2 are measured by means of the thermocouples 6,7 inserted into the baths at positions close to the respective partitioning boards 3,3 or, rather, close to the work piece 8 to be subsequently inserted between the partitioning boards 3,3 as is illustrated in FIG. 1*a* and FIG. 1*b* which is a vertical cross sectional view of the salt-bath apparatus as cut and viewed along the line Ib—Ib in FIG. 1*a*. Needless to say, the outputs from the thermocouples 6,7 serve as a control signal to the respective automatic temperature regulators (not shown in the figures) so as to keep the salt baths at the respective desired higher and lower temperatures. If necessary, a cooling means can be provided in the compartment 2 which should be kept at a lower temperature than the compartment 1.

When a stationary state has been established in the above described manner relative to the temperature distribution between the salt-bath compartments 1,2, a slab 8 of a nodular graphite cast iron as the work piece after austenitization having approximately identical dimensions with the partitioning boards 3,3 is inserted between the partitioning boards 3,3 which are then quickly removed so as to expose the surfaces of the cast iron slab 8 to the melts of the salt baths in the respective compartments 1,2 at different temperatures for a length of time sufficient for the austempering heat treatment. When the size of the work piece 8 of cast iron is smaller than the partitioning boards 3,3, the work piece 8 is held with a jig or holder having dimensions sufficient to prevent mixing of the salt melts contained in the two salt-bath compartments 1,2.

When the starting body of a nodular graphite cast iron is in a tubular form, the austempering heat treatment according to the inventive method is performed by holding the pipe in the bath of a molten salt kept at a constant and uniform temperature and continuously passing through the pipe a melt of a salt at a temperature different from that of the salt bath so as to produce a temperature difference between the inner and outer surfaces of the pipe.

Further, when a temperature difference is desired to be produced within a plane of a plate or slab, a possible way to produce such a temperature distribution is that a number of nozzles each directed against the surface are installed in such an arrangement as to cover the whole surface of the plate or slab to be treated and each of the nozzles serves to eject a melt of a salt at a temperature different from the other nozzles against the surface.

The ADI bodies obtained according to the inventive method have a gradient of the mechanical properties within the body corresponding to the temperature gradient in the austempering heat treatment with a possibility that the mechanical properties such as strength and toughness can be varied within the body to serve most satisfactorily for the particular application.

In the following, the method of the invention is illustrated in more detail by way of an example which, however, never limits the scope of the invention in any way.

Example.

Into the compartments of the salt-bath apparatus shown in FIGS. 1*a* and 1*b* were introduced 15 kg of an equimolar blend of potassium nitrate and sodium nitrate to serve as a salt for the salt bath and, after melting, a pair of partitioning boards of stainless steel were inserted into the conduit between the compartments. The melts of the salt in the compartments were heated and kept at temperatures of, one, 375° C. and, the other, 275° C. under agitation with the stirrers in order to ensure uniformity of the temperature within the respective compartments. Cold air was passed through a pipe line immersed in the salt bath at 275° C. to facilitate maintaining a temperature difference of 100° C. between the compartments.

After establishment of a stationary state of the temperature distribution in the above described manner, a slab of a nodular graphite cast iron having dimensions of 84 mm by 88 mm by 11 mm after austenitization by heating at 900° C. for 90 minutes in an atmosphere of argon was inserted into the salt bath between the partitioning boards and the partitioning boards were quickly removed by pulling up. Substantially no changes were noted in the temperature of the salt bath in the respective compartments despite the introduction of the cast iron slab at the high temperature owing to the great difference in the heat capacity between the salt bath and the cast iron slab. After holding the cast iron slab between the compartments for 90 minutes to effect the austempering heat treatment at 375° C. on one surface and at 275° C. on the other, the cast iron slab was taken out of the salt bath and air-cooled to give an ADI body.

Figure 2:
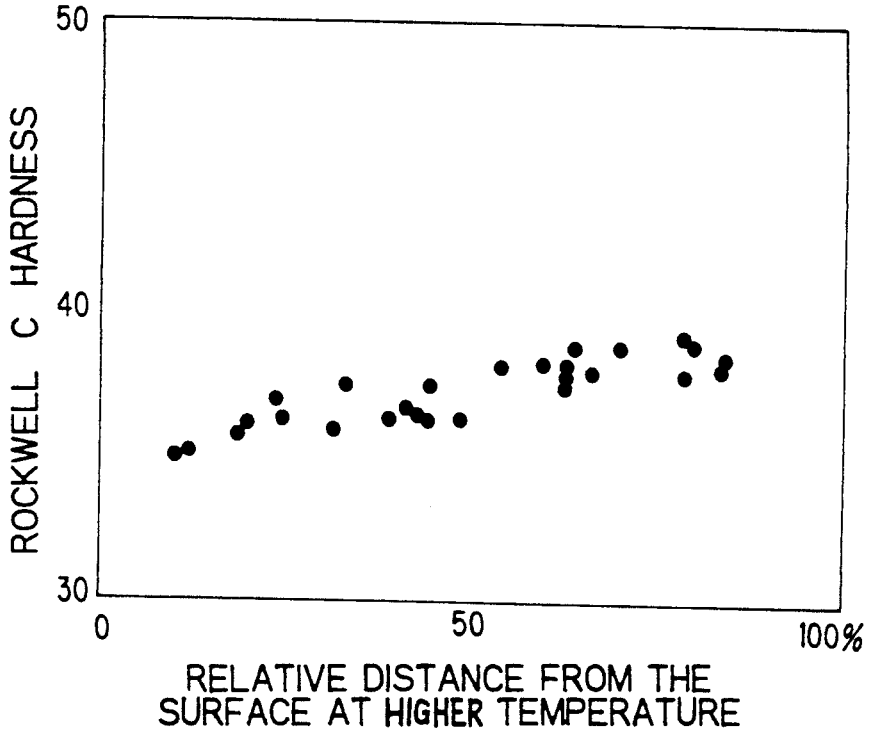
FIG. 2 is a plot showing distribution of the Rockwell C hardness of an ADI body prepared in the example according to the inventive method as a function of the relative distance between surfaces of a slab.

The ADI body obtained by the above described gradient austempering treatment was subjected to the measurement of the Rockwell C hardness along the direction of the thickness, i.e. the direction of the temperature gradient in the austempering treatment, to give the results plotted in FIG. 2, of which the ordinate is for the Rockwell C hardness and the abscissa is for the relative distance of the measuring point in % from the surface which had been at the higher temperature of 375° C. during the austempering heat treatment, the surface at the lower temperature of 275° C. being indicated by 100%. As is understood from this FIG., the Rockwell C hardness of the ADI body increases monotonously and continuously within the body from the surface at the higher temperature to the surface at the lower temperature during the austempering heat treatment.

Incidentally, it is well known that the Rockwell C hardness and the tensile strength of ADI materials are in good correlation with each other so that the above obtained results of the Rockwell C hardness could give a good measure for the tensile strength.

Figure 3:
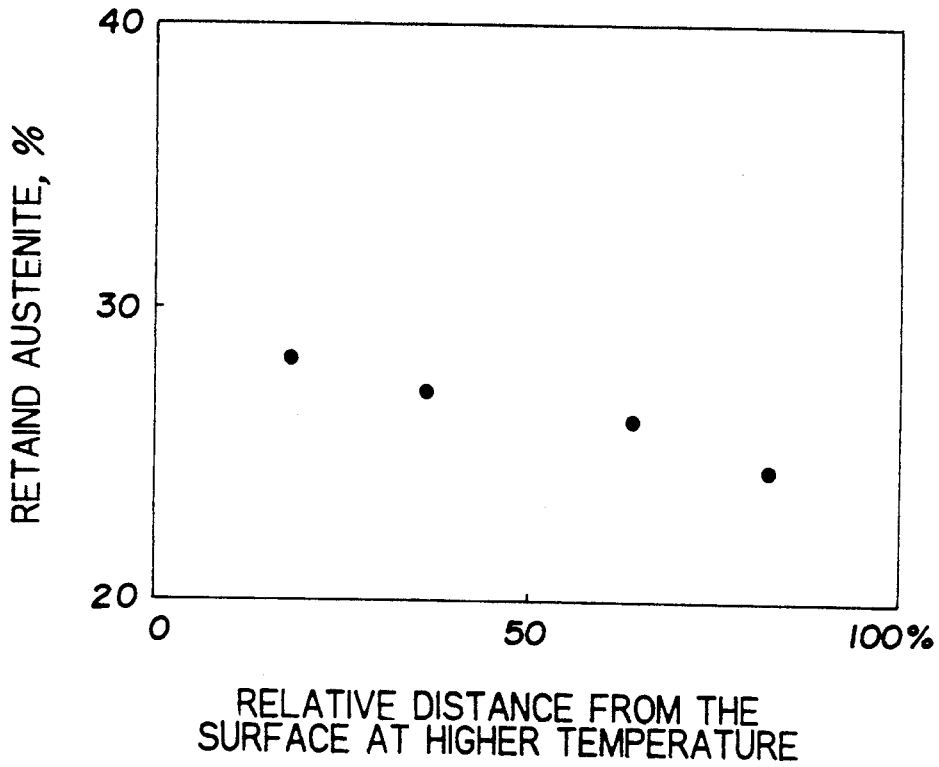
FIG. 3 is a plot showing distribution of the content of the retained austenite within an ADI body prepared in the example according to the inventive method as a function of the relative distance between surfaces of a slab.

Further, FIG. 3 shows the distribution of the content of the retained austenite within the ADI body as a function of the relative depth from the surface at the higher temperature of 375° C. during the austempering heat treatment. As is understood from this figure, the content of the retained austenite decreases from the surface at the higher temperature to the surface at the lower temperature during the austempering treatment suggesting that the near-threshold fatigue crack growth behavior, which has a close relationship with the content of the retained austenite in ADI materials, varies from one surface to the other.

What is claimed is:

1. A method for the preparation of a body of an austempered ductile cast iron having a gradient of a mechanical property within the body, which comprises: subjecting a body of a nodular graphite cast iron to an isothermal transformation treatment for austempering at a temperature in the range from 250° to 450° C. while the body has a temperature difference between two points or between two surfaces produced by bringing the two points or two surfaces of the body into contact with melts of a salt kept at different temperatures.

* * * * *